US007249654B2

(12) United States Patent
Nakamoto et al.

(10) Patent No.: US 7,249,654 B2
(45) Date of Patent: Jul. 31, 2007

(54) HEAT INSULATING ACOUSTICAL STRUCTURE AND CARBODY SHELL STRUCTURE USING THE SAME

(75) Inventors: Hidekazu Nakamoto, Kudamatsu (JP); Seijiro Todori, Hikari (JP); Takeshi Kawasaki, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/349,085

(22) Filed: Feb. 8, 2006

(65) Prior Publication Data

US 2006/0175126 A1 Aug. 10, 2006

(30) Foreign Application Priority Data

Feb. 9, 2005 (JP) ..... 2005-032691
Jan. 24, 2006 (JP) ..... 2006-015226

(51) Int. Cl.

| | |
|---|---|
| ***E04B 1/88*** | (2006.01) |
| *E04B 1/82* | (2006.01) |
| *E04B 1/84* | (2006.01) |
| *E04B 1/76* | (2006.01) |
| *E04B 1/78* | (2006.01) |
| *B61D 17/00* | (2006.01) |

(52) U.S. Cl. ..... 181/290; 181/295; 105/452; 296/39.3

(58) Field of Classification Search ..... 181/290, 181/292, 295; 105/397, 399, 423, 452; 296/39.3
See application file for complete search history.

(56) References Cited

U.S. PATENT DOCUMENTS 2,219,440 A * 10/1940 Burgess ..... 52/145
2,745,173 A * 5/1956 Janos ..... 65/483
4,167,598 A * 9/1979 Logan et al. ..... 428/34.1

(Continued)

FOREIGN PATENT DOCUMENTS

DE 33 11 905 A1 10/1984

(Continued)

OTHER PUBLICATIONS

Patent Abstracts of Japan, vol. 1998, No. 14, JP 10 258736, Sep. 29, 1998.

(Continued)

*Primary Examiner*—Edgardo San Martin
(74) *Attorney, Agent, or Firm*—Antonelli, Terry, Stout & Kraus, LLP.

(57) ABSTRACT

To obtain a wide passenger compartment space, the thickness of a heat insulating acoustical layer is reduced, and for this purpose, a comfortable in-car environment is obtained by using a vacuum insulating panel which combines high heat insulating performance and sound insulating performance. A heat insulating acoustical layer 20 is formed on one surface of a lightweight alloy structure 10 of double skin construction by using a vacuum insulating panel 21 as a middle member and sandwiching two surfaces of the panel with elastic sound absorbing materials 22, 23 made of a nonwoven fabric or a foamed body, and the heat insulating acoustical layer is covered with an interior material 24. Owing to this construction, the transmission loss of a noise which transmits from the double skin structure side is improved by the mutual actions of the elasticity of the sound absorbing material and the rigidity of the vacuum heat insulating panel.

8 Claims, 3 Drawing Sheets

U.S. PATENT DOCUMENTS

| | | | | |
|---|---|---|---|---|
| 5,094,899 | A | 3/1992 | Rusek, Jr. | |
| 5,504,282 | A * | 4/1996 | Pizzirusso et al. | 181/290 |
| 5,851,626 | A * | 12/1998 | McCorry et al. | 428/95 |
| 6,644,535 | B2 * | 11/2003 | Wallach et al. | 228/173.5 |

FOREIGN PATENT DOCUMENTS

| | | | |
|---|---|---|---|
| JP | 09175389 | A * | 7/1997 |
| JP | 09317044 | A * | 12/1997 |
| JP | 10-258736 | | 9/1998 |
| JP | 11-100915 | | 4/1999 |
| JP | 11222125 | A * | 8/1999 |
| JP | 2006150647 | A * | 6/2006 |
| JP | 2006169800 | A * | 6/2006 |

OTHER PUBLICATIONS

"Vehicular Technology" Sep. 2001, No. 222, pp. 22-31.

* cited by examiner

HEAT INSULATING ACOUSTICAL STRUCTURE AND CARBODY SHELL STRUCTURE USING THE SAME

The present application is based on and claims priorities of Japanese patent application No. 2005-032691 filed on Feb. 9, 2005 and Japanese patent application No. 2006-015226 filed on Jan. 24, 2006, the entire contents of which are hereby incorporated by reference.

BACKGROUND OF THE INVENTION

1. Field of the Invention

The present invention relates to a railway car or a monorail car in which a vacuum insulating material and a sound absorbing material are used.

2. Description of the Related Art

In recent years, car bodies using large-size hollow molded materials made of light metal (of double skin construction) have been fabricated from the standpoint of weight saving and pressure tightness improvement which result from the rationalization of fabrication and high speed design. In order to save weight and improve pressure tightness, these car bodies are constructed so that their side portions and roof shell structures have curved surfaces. For example, such a shell structure is observed in a car described in the Japanese Patent Laid-Open Publication No. 10-258736.

The current mainstream of a heat insulating structure used in such a carbody shell structure is such that the entry of heat from outside a carbody is prevented by sticking a fibrous heat insulating material, such as glass wool, between the in-car side of a carbody shell structure and an outfitting lining. However, if such a structure is applied to a double skin shell structure, the thickness of a wall increases and especially in railroad cars, it is required to reduce the thickness as far as possible from the standpoint of ensuring an in-car space. For this reason, materials excellent in heat insulating performance have been used. To meet these requirements, carbody structures using vacuum insulating materials as those described in the Japanese Patent Laid-Open Publication No. 10-258736 and the Japanese Patent Laid-Open Publication No. 11-100915 have been investigated.

A method of reducing in-car noise by imparting vibration damping performance to a structure of railroad car is described in "Vehicular Technology," December 2001/9, No. 222, pp. 22-31. Although it can be expected that this method is effective in reducing noise, the thickness of a heat insulating material for obtaining heat insulating properties becomes large and this poses a problem in ensuring a wide in-car space.

In the above-described conventional technique, in attaching a vacuum insulating material to a carbody shell structure, a large force is locally applied to a core material of the vacuum insulating material when the vacuum insulating material is directly pressed against the surface of the carbody shell structure, with the result that the core material is deformed and that an outer container of the heat insulating material is broken. This poses the problem that airtightness is lost and heat insulating performance decreases.

There has been proposed a method in which by use of a rail portion on the in-car side, the surface of a vacuum insulating material is pressed and fixed by a spring material of steel sheet. However, because the vacuum insulating material is pressed for a long period, the outer container and the core material are deformed and sink down, and it is feared that eventually cracks would occur.

In the method of reducing in-car noise by sticking a vibration damping material to a double skin shell structure, a weight increase of the shell structure and the thickness of the heat insulating material pose a problem, and thin wall design of the heat insulating acoustical function is demanded.

SUMMARY OF THE INVENTION

The above object can be achieved by providing a heat insulating acoustical structure having a double skin structure of lightweight alloy fabricated from two plates and a rib connecting the two plates and a heat insulating acoustical layer laminated on an in-car side on one surface of the double skin structure, in which the heat insulating acoustical structure is fabricated by laminating a sound absorbing material having elasticity, a vacuum insulating material and an interior material panel in order from the double skin structure toward the in-car side.

As a result of this, by laminating a sound absorbing material, a vacuum insulating material and an interior material panel in order from the double skin structure toward the in-car side, the transmission loss of a noise which transmits from the double skin structure side can be improved by the mutual actions of the elasticity of the sound absorbing material and the rigidity of the vacuum heat insulating panel.

Also, the above object can be achieved by providing a heat insulating acoustical structure having a double skin structure of lightweight alloy fabricated from two plates and a rib connecting the two plates and a heat insulating acoustical layer laminated on an in-car side on one surface of the double skin structure, in which the heat insulating acoustical layer comprises a vacuum insulating panel which has rigidity and is provided in the form of a flat plate in the direction of laminating, a sound absorbing material made of a fibrous nonwoven fabric or a foamed body having elasticity, which is laminated on both surfaces of the vacuum insulating panel in the direction of laminating, and an interior material panel which is provided on the in-car side of the heat insulating acoustical structure and covers the heat insulating acoustical structure.

DETAILED DESCRIPTION OF THE PREFERRED EMBODIMENTS

Embodiments of the present invention will be described on the basis of the accompanying drawings.

Embodiment 1

Figure 1:
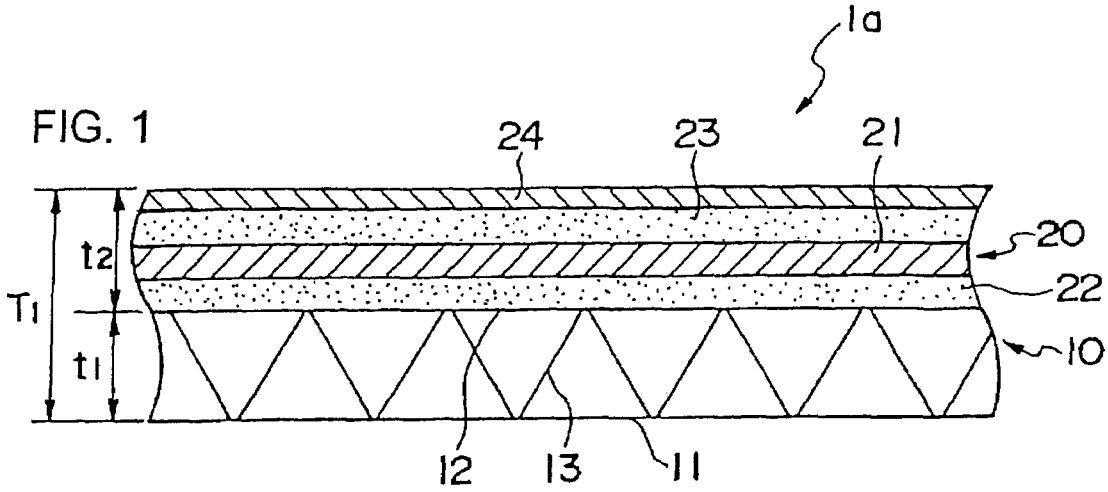
FIG. 1 is a cross-sectional view which shows the laminating relationship between a vacuum insulating material and a sound absorbing material of the present invention.

FIG. 1 shows the sectional construction of a heat insulating acoustical structure related to the first embodiment of the present invention. The heat insulating acoustical structure, the whole of which is indicated by the reference numeral 1*a*, has a double skin structure 10 and a heat insulating acoustical layer 20 which is laminated on an in-compartment side surface, which is one surface of the double skin structure 10.

The double skin structure 10 is a molded material fabricated by the extrusion molding of an aluminum alloy, for example, and has a sectional construction in which parallel two plate materials 11, 12 are connected by a rib 13 of truss construction.

The heat insulating acoustical layer 20 is installed on the in-car side of the double skin structure 10, and has a construction in which both sides of a vacuum insulating panel 21 are sandwiched by sound absorbing materials 22, 23 having elasticity, which are fabricated from a fibrous nonwoven fabric or a foamed body. That is, the sound absorbing material 22, the vacuum insulating panel 21 and the sound absorbing material 22 are laminated in order on the in-car side of the double skin structure. An interior material panel 24 is laminated on the in-car side of the sound absorbing material 23.

The vacuum insulating panel 21 is a panel which is formed in roughly rectangular shape by covering a core material with a film having airtightness and in which heat insulating properties are increased by producing a vacuum inside. This panel has a thickness of 6 mm. This thickness of the vacuum insulating material 21 is only an example and is not limited to this value. Grooves are provided as required so that the vacuum insulating material 21 can be easily brought into close contact with curved surfaces.

Relative movement preventing means is provided each on contact surfaces between the vacuum insulating panel 21 of the heat insulating acoustical layer 20 and the sound absorbing material (fibrous nonwoven fabric) 23 on one surface side, on contact surfaces between the sound absorbing material 23 and the interior material panel 24, and on contact surfaces between the other surface side of the vacuum insulating panel 21 and the sound absorbing material 22. The relative movement preventing means is bonded with an adhesive or with a double stick tape. Alternatively, the relative movement preventing means is constituted by mechanical means (a mechanism).

This mechanical means is formed from a thing which is generally called MAGIC TAPE (brand name). One member of MAGIC TAPE is attached to one member on the contact surfaces, and the other member of MAGIC TAPE is attached to the other member on the contact surfaces. Concretely, one member has many protrusions which protrude toward the other member, and the other member has many concavities which the protrusions enter.

This relative movement preventing means (mechanism) is provided in order to prevent each member of the heat insulating acoustical layer 20 from vibrating due to the vibration of the double skin structure 10 and generating noise.

The sound absorbing material 22 and the plate 12 of the double skin structure 10 are only in contact with each other, and the above-described relative movement preventing means is not provided.

The interior material panel 24 is fabricated by sticking a resin sheet or the like on a surface of an aluminum plate, and the thickness of the panel 24 is about 2 mm. The interior material panel 24 may be fabricated by filling a resin between two thin aluminum plates or by sandwiching a foamed insulating material between two thin aluminum plates. It is not always necessary that the aluminum plate have flat surfaces. The aluminum plate may have corrugated surfaces. The corrugated member may be the same member as the aluminum plate or can be a different member.

The sound absorbing material 22 of the heat insulating acoustical layer is a fibrous nonwoven fabric of glass fiber and has a thickness of 8 mm.

The sound absorbing material 23 of the heat insulating acoustical layer is a foamed body having elasticity and has a thickness of 8 mm.

The thickness $t_1$ of the double skin structure 10 is 40 mm, the thickness $t_2$ of the heat insulating acoustical layer 20 is 24 mm, and the structural thickness $T_1$ of the heat insulating acoustical structure 1*a* becomes 64 mm.

Figure 4:
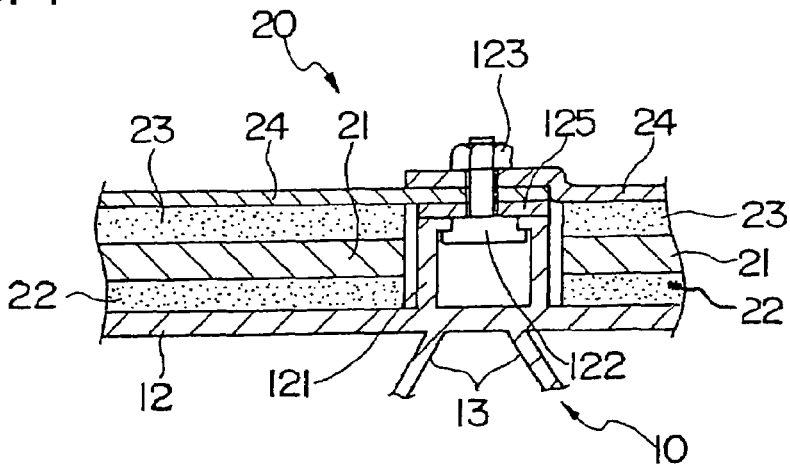
FIG. 4 is a sectional view which shows an attaching structure of a heat insulating acoustical layer in an embodiment of the present invention to a double skin structure.

Next, an attaching structure of the heat insulating acoustical layer 20 to the double skin structure 10 will be described on the basis of FIG. 4. The sound absorbing material 23 is bonded to the interior material panel 24 of the heat insulating acoustical layer 20. The sound absorbing material 23 and the vacuum insulating panel 21 are bonded together with an adhesive. The vacuum insulating panel 21 and the sound absorbing material 22 are bonded together with an adhesive.

After the heat insulating acoustical layer 20 is fabricated as described above, the heat insulating acoustical layer 20 is mounted to the double skin structure 10. A peripheral portion of the interior material panel 24 of the heat insulating acoustical layer 20 is larger than the sound absorbing materials 22, 23 on the double skin structure 10 side and a peripheral portion of the vacuum insulating panel 21. In an in-compartment side of the double skin structure 10, a curtain rail 121 for fixing the interior material panel 24 protrudes. As is well known, the top of two walls of the curtain rail 121 protrudes toward inside of the two walls. The head portion of a T-type bolt 122 is caught to the top of the curtain rail. The T-type bolt 122 is fixed from the inside of the car with a nut 123. Before fixing the nut 123, the T-type bolt 122 has been attached to the curtain rail 121. 125 is a heat insulating material and the thickness is 2 mm. The protruding height of the curtain rail 121 is about 20 mm. The thickness of one heat insulating acoustical layer 20 is larger than the thickness of the other heat insulating acoustical layer 20.

As a result of this, the heat insulating acoustical layer 20 is constituted by multiple members. However, because the multiple members are fixed as one piece, the attaching of the heat insulating acoustical 20 to the double skin structure can be easily performed. Because the interior material panel 24, the vacuum insulating panel 21 and the sound absorbing materials 22, 23 are light in weight, their handling can be easily performed even when they are assembled as one piece.

Figure 3:
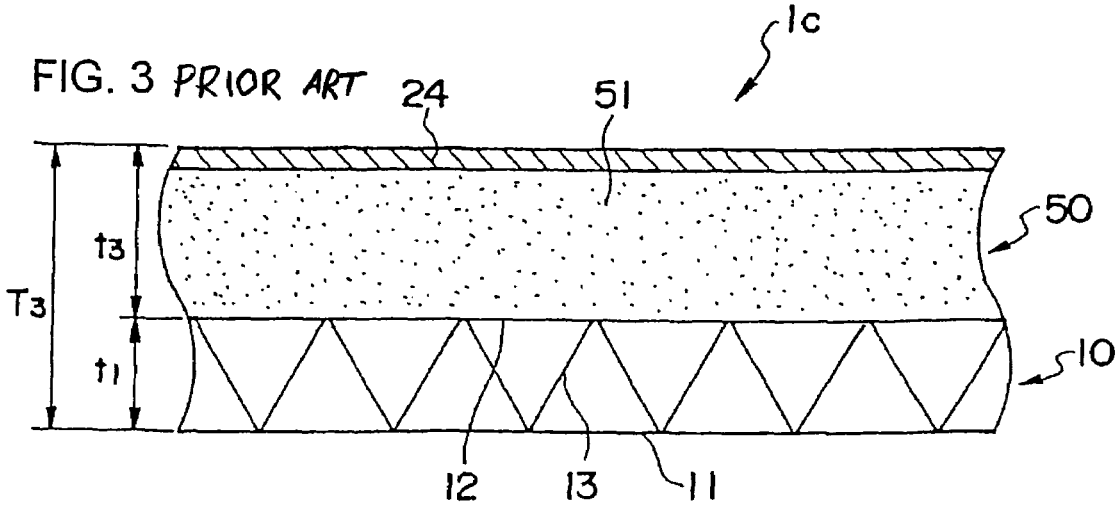
FIG. 3 PRIOR ART
FIG. 3 is a cross-sectional view which shows the sectional structure of a conventional car.

FIG. 3 shows a conventional heat insulating acoustical structure. This heat insulating acoustical structure 1*c* has a double skin structure 10 and an acoustical layer 50.

The double skin structure 10 is the same as shown in FIG. 1 and an extruded material of aluminum alloy. The acoustical layer 50 has a glass-fiber-based heat insulating acoustic material 51, for example. An interior material panel 24 is attached to the in-car side of the heat insulating acoustic material 51. This panel 24 is the same as shown in FIG. 1.

The thickness $t_1$ of the double skin structure 10 is 40 mm, the same thickness as in FIG. 1. The thickness $t_3$ of the acoustical layer 50 including the interior material panel 24 is 50 mm.

Therefore, the structural thickness $T_3$ of the whole is 90 mm.

In contrast to this, the structural thickness $T_1$ of the heat insulating acoustic structure of Embodiment 1 shown in FIG. 1 is 64 mm and, therefore, the thickness is substantially reduced.

Figure 5:
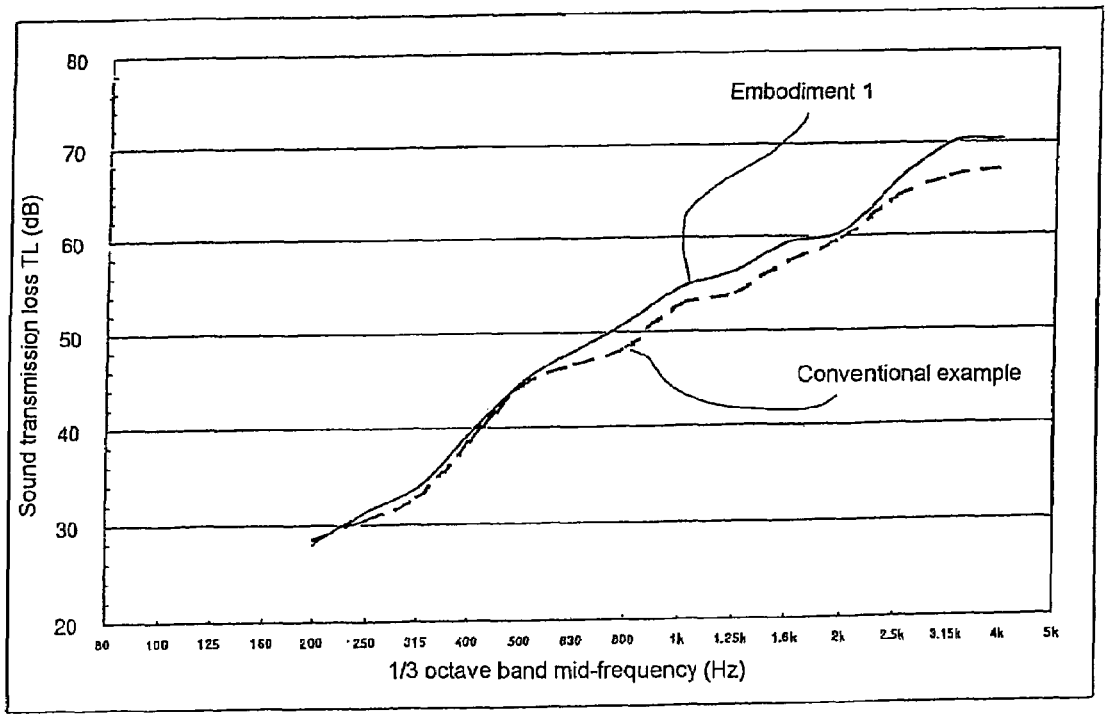
FIG. 5 is a graph which shows results of a comparison of sound transmission loss between an embodiment of the present invention and a conventional structure.

FIG. 5 shows results a comparison of sound insulation performance between Embodiment 1 and the conventional structure shown in FIG. 3.

In FIG. 5, the frequency of sound is taken as abscissa and the transmission loss of sound is plotted as ordinate.

Compared to the conventional structure, the structure of the embodiment enables the sound transmission loss to be set at a high level in spite of its small structural thickness. That is, it was experimentally confirmed that the structure of the embodiment is excellent in sound insulation properties.

This is explained as follows. A mass damper is formed by the mutual actions of the elastic spring action of the sound absorbing material having elasticity and the rigidity of the vacuum heat insulating material and the sound transmission loss is improved.

Also, it was experimentally confirmed that by providing the vacuum insulating material, the embodiment has a heat insulating effect as high as twice that of the conventional example.

Embodiment 2

Figure 2:
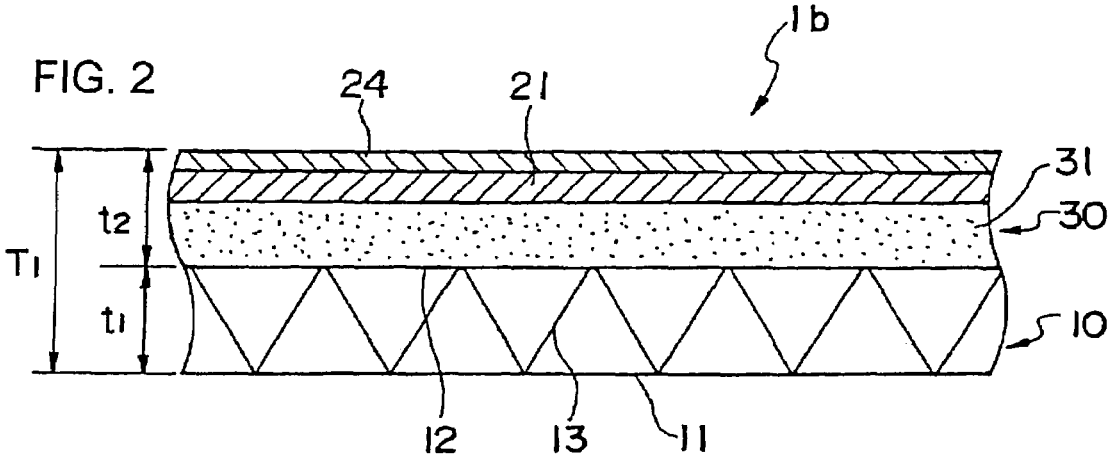
FIG. 2 is a cross-sectional view which shows the laminating relationship between a vacuum insulating material and a sound absorbing material of another embodiment of the present invention.

Another embodiment of the present invention is shown in FIG. 2. In a heat insulating acoustical structure 1*b* of this embodiment, a vacuum insulating panel 21 is provided immediately under an interior material panel 24. A sound absorbing material 31 is formed from the same material as the fibrous nonwoven fabric 22 used in Embodiment 1. The thickness of the sound absorbing material 31 is 16 mm. The vacuum insulating panel 21, the interior material panel 24 and the double skin structure 10 are the same as in Embodiment 1.

The thickness $t_1$ of the double skin structure is 40 mm, the same thickness as in Embodiment 1. The thickness $t_3$ of the acoustical layer 30 is 24 mm, the same thickness as in Embodiment 1.

The sound transmission loss was measured on test pieces of the same size by using FIG. 3 of the above-described comparative model as an object of comparison.

Figure 6:
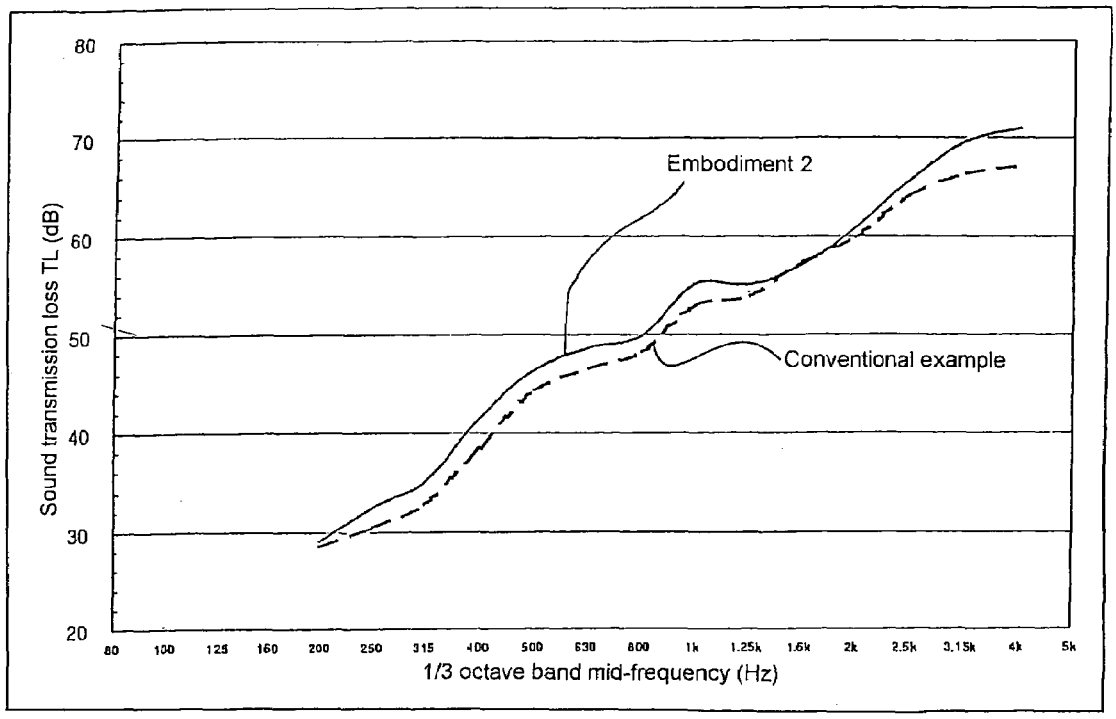
FIG. 6 is a graph which shows results of a comparison of sound transmission loss between another embodiment of the present invention and a conventional structure.

The result is shown in FIG. 6. From the figure it is apparent that a mass damper is formed by the mutual actions of the elastic spring action of the sound absorbing material and the rigidity of the vacuum heat insulating material in spite of a 26 mm decrease in structural thickness $T_1$ from 90 mm to 64 mm, with the result that the sound transmission loss is improved. Furthermore, compared to FIG. 5, the sound transmission loss is improved in a low frequency zone of not more than 1 kHz.

Therefore, when noise in a low frequency zone is to be removed, it is effective to adopt the construction of this embodiment. The sound absorbing material 31 of this embodiment may be an elastic foamed body or may be either of a fibrous nonwoven fabric or a foamed body, and also it is possible to laminate multiple layers of different kinds.

Also for heat insulating performance, it is apparent that the same performance as that of Embodiment 1 can be ensured because members having the same performance as in Embodiment 1 are used.

The present invention can be used in constructing a heat insulating acoustical structure for transportation vehicles (for example, a railway car or a monorail car) for which volume efficient is important.

What is claimed is:

1. A heat insulating acoustical structure having a double skin structure of lightweight alloy fabricated from two plates and a rib connecting the two plates and a heat insulating acoustical layer laminated on an in-car side on one surface of the double skin structure, wherein the heat insulating acoustical layer comprises:

a vacuum insulating panel which has rigidity and is provided in the form of a flat plate;

a sound absorbing material made of a fibrous nonwoven fabric or a foamed body having elasticity, which is laminated on both surfaces of the vacuum insulating panel;

and an interior material panel which is provided on the in-car side of the heat insulating acoustical structure and covers the heat insulating acoustical structure.

2. The heat insulating acoustical structure according to claim 1, wherein the vacuum insulating panel and the fibrous nonwoven fabric, or the vacuum insulating panel and the foamed body, and the interior material panel and the fibrous nonwoven fabric or the foamed body, both being in contact with the interior material panel, are each connected together with an adhesive, an adhesive tape or a relative movement preventing mechanism which prevents a relative movement between the two.

3. A heat insulating acoustical structure having a double skin structure of lightweight alloy fabricated from two plates and a rib connecting the two plates and a heat insulating acoustical layer laminated on an in-car side on one surface of the double skin structure, wherein the heat insulating acoustical layer comrpises a vacuum insulating panel rigidity and is provided in the form of a flat plate;

a sound absorbing material; and an inner material panel; and wherein the heat insulating acoustical layer is fabricated by laminating the sound absorbing material, the vacuum insulating panel and the inner material panel in order from the double skin structure toward an in-car side.

4. The heat insulating acoustical structure according to claim 1, wherein the sound absorbing material is a fibrous nonwoven fabric.

5. The heat insulating acoustical structure according to claim 3, wherein the sound absorbing material of the heat insulating acoustical structure is constituted by multiple layers.

6. The heat insulating acoustical structure according to claim 3, wherein the vacuum insulating panel and the interior material panel, and the vacuum insulating panel and the sound absorbing material, are each connected together with an adhesive, an adhesive tape or a relative movement preventing means which prevents a relative movement between the two.

7. A carbody shell structure having the heat insulating acoustical structure according to claim 1 or 3.

8. The heat insulating acoustical structure according to claim 3, wherein the sound absorbing material is a fibrous nonwoven fabric.

* * * * *